US007284918B2

(12) United States Patent
Nunokawa

(10) Patent No.: US 7,284,918 B2
(45) Date of Patent: Oct. 23, 2007

(54) RECORDING METHOD, COMPUTER-READABLE MEDIUM, AND RECORDING APPARATUS

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 192 days.

(21) Appl. No.: 10/628,552

(22) Filed: Jul. 29, 2003

(65) Prior Publication Data

US 2004/0135836 A1 Jul. 15, 2004

(30) Foreign Application Priority Data

Jul. 30, 2002 (JP) ..... 2002-221969

(51) Int. Cl.

| | |
|---|---|
| ***B41J 11/20*** | (2006.01) |
| ***B41J 13/02*** | (2006.01) |
| ***B41J 13/08*** | (2006.01) |
| ***B41J 25/308*** | (2006.01) |
| ***B65H 7/00*** | (2006.01) |

(52) U.S. Cl. ..... 400/56; 271/256; 271/274; 347/8; 400/636.2

(58) Field of Classification Search ..... 271/256, 271/274, 188, 259, 258.01, 242; 347/104, 347/101, 8, 37; 400/56, 636.2, 642
See application file for complete search history.

(56) References Cited

U.S. PATENT DOCUMENTS

| | | | | |
|---|---|---|---|---|
| 4,620,807 | A * | 11/1986 | Polit | 400/56 |
| 4,941,021 | A * | 7/1990 | Uchida et al. | 399/322 |
| 5,393,151 | A * | 2/1995 | Martin et al. | 400/642 |
| 5,415,387 | A * | 5/1995 | Suzuki | 271/10.02 |
| 5,419,644 | A * | 5/1995 | Martin et al. | 400/642 |
| 5,527,123 | A * | 6/1996 | Jackson et al. | 400/642 |
| 5,529,405 | A * | 6/1996 | Breitenbach et al. | 400/56 |
| 5,543,909 | A * | 8/1996 | Quesnel | 399/394 |
| 5,576,744 | A * | 11/1996 | Niikura et al. | 347/14 |
| 5,683,187 | A * | 11/1997 | Tunmore | 400/58 |
| 5,775,690 | A * | 7/1998 | Quesnel et al. | 271/242 |
| 5,904,350 | A * | 5/1999 | Creighton et al. | 271/227 |
| 5,982,400 | A * | 11/1999 | Yokoi et al. | 346/134 |
| 6,189,990 | B1 * | 2/2001 | Youn | 347/8 |
| 6,338,481 | B1 * | 1/2002 | Maruchi | 271/188 |
| 6,406,110 | B1 * | 6/2002 | Ahne et al. | 347/8 |
| 6,616,355 | B2 * | 9/2003 | Cleary et al. | 400/56 |
| 6,666,536 | B2 * | 12/2003 | Nakanishi et al. | 347/8 |
| 6,672,696 | B2 * | 1/2004 | Fairchild et al. | 347/8 |
| 2002/0063384 | A1 * | 5/2002 | Quesnel | 271/270 |
| 2002/0067940 | A1 * | 6/2002 | Sasai et al. | 400/61 |
| 2003/0179270 | A1 * | 9/2003 | Yamamoto et al. | 347/102 |

* cited by examiner

*Primary Examiner*—Gene O. Crawford
*Assistant Examiner*—Rakesh Kumar
(74) *Attorney, Agent, or Firm*—Sughrue Mion, PLLC

(57) ABSTRACT

A recording method, for example, which allows a recording medium to be carried with high carrying precision is to be achieved. A recording method includes a step of changing a carry command value, when carrying a recording medium, according to a state of bending of the recording medium that is carried, a step of carrying the recording medium based on the carry command value that has been changed, and a step of recording on the recording medium that has been carried.

15 Claims, 16 Drawing Sheets carry characteristics table

| paper type | aggregate carry amount (inch) | correction value | correction amount (inch) |
|---|---|---|---|
| A4 | 1 | 1 | +1/5760 |
| (thin paper) | 2 | 1 | +1/5760 |
| | 3 | 0 | 0 |
| | 4 | 0 | 0 |
| | 5 | 0 | 0 |
| | 6 | 0 | 0 |
| | 7 | 0 | 0 |
| | 8 | 0 | 0 |
| | 9 | −1 | −1/5767 |
| | 10 | −1 | −1/5767 |
| A4 | 1 | 3 | +3/5760 |
| (thick paper) | 1.25 | 3 | +3/5760 |
| | 1.5 | 2 | +2/5760 |
| | 2 | 2 | +2/5760 |
| | 2.5 | 1 | +1/5760 |
| | 3 | 1 | +1/5761 |
| | 3.5 | 1 | +1/5762 |
| | 4 | 1 | +1/5763 |
| | 4.5 | 1 | +1/5764 |
| | 5 | 0 | 0 |
| | 5.5 | 0 | 0 |
| | 6 | 0 | 0 |
| | 7 | 0 | 0 |
| | 8 | 0 | 0 |
| | 8.5 | −1 | −1/5767 |
| | 9 | −1 | −1/5767 |
| | 9.25 | −1 | −1/5767 |
| | 9.5 | −1 | −1/5767 |
| | 9.75 | −2 | −2/5767 |
| | 10 | −2 | −2/5767 |
| postcard | 1 | 2 | +2/5760 |
| | 2 | 1 | +1/5761 |
| | 3 | 0 | 0 |
| | 4 | 0 | 0 |
| | 5 | −1 | −1/5767 |

| paper type | aggregate carry amount (inch) | correction value | correction amount (inch) |
|---|---|---|---|
| A4 | 1 | 3 | +3/5760 |
| OHP sheet | 2 | 2 | +2/5760 |
| | 3 | 2 | +2/5760 |
| | 4 | 1 | +1/5761 |
| | 5 | 0 | 0 |
| | 6 | 0 | 0 |
| | 7 | −1 | −1/5767 |
| | 8 | −2 | −2/5767 |
| | 9 | −2 | −2/5767 |
| | 10 | −3 | −3/5767 |
| A3 | 1 | 3 | +3/5760 |
| (thin paper) | 2 | 3 | +3/5760 |
| | 3 | 2 | +2/5760 |
| | 4 | 2 | +2/5760 |
| | 5 | 1 | +1/5760 |
| | 6 | 1 | +1/5761 |
| | 7 | 1 | +1/5762 |
| | 8 | 1 | +1/5763 |
| | 9 | 1 | +1/5764 |
| | 10 | 0 | 0 |
| | 11 | 0 | 0 |
| | 12 | 0 | 0 |
| | 13 | 0 | 0 |
| | 14 | 0 | 0 |
| | 15 | −1 | −1/5767 |
| | 16 | −1 | −1/5767 |
| | 17 | −1 | −1/5767 |
| | 18 | −1 | −1/5767 |
| | 19 | −2 | −2/5767 |
| | 20 | −2 | −2/5767 |

FIG. 5 when the error is $-\delta$
(dark banding occurs between L2 and L3)

when the error is $+\delta$
(bright banding occurs between L2 and L3)

RECORDING METHOD, COMPUTER-READABLE MEDIUM, AND RECORDING APPARATUS

CROSS-REFERENCE TO RELATED APPLICATION

The present application claims priority upon Japanese Patent Application No. 2002-221969 filed on Jul. 30, 2002, which is herein incorporated by reference.

BACKGROUND OF THE INVENTION

1. Field of the Invention

The present invention relates to recording methods, computer-readable media, and recording apparatuses.

2. Description of the Related Art

Printers for printing on a paper using a recording agent such as ink or toner are known as recording apparatuses for recording on a recording medium that is carried. Such printers are preferably compact in order to reduce the area in which they are placed, and preferably the area occupied by such printers, including the space for setting the paper and the space for stacking paper that has been discharged, is made small. In order to achieve this, the route over which the paper is carried is formed curved so that paper set on an upper section of the printer is discharged toward the front of the printer or so that paper supplied from a lower side of the printer is discharged above the section from which the paper was supplied.

FIG. 17 is a cross-sectional view showing how paper is bent inside an inkjet printer. The diagram shows how a paper P that is supplied from a paper supply section 100 by a paper supply roller 101 is guided by a paper supply guide 102 and a carry guide 103 and arrives at a carry roller 104, after which it is carried by the carry roller 104. That is, the paper P is carried along the guides 102 and 103, for example, within the printer as it is significantly bent between the carry roller 104 and the paper supply guide 102.

However, when the paper P is bent as it is carried as described above, the rebound force caused by the elasticity of the distorted paper P predisposes the bent paper P to return to an unbent state. The rebound force at this time acts to return the paper P toward the paper supply section 100 if the area that is bent is the front end side of the paper P, and if that area is the rear end side of the paper, then the rebound acts to push the paper P in the discharge direction. That is, when an external force such as that described above acts on the paper P as it is being carried, error occurs in the carry amount even if the paper P is carried at a constant carry force by the carry roller 104. When error occurs in the carry amount in this way, there is the problem that printers and the like, for which particularly high picture quality is demanded, experience a drop in the picture quality of printed images.

SUMMARY OF THE INVENTION

The present invention has been arrived at in light of the foregoing problems, and it is an object thereof to achieve a recording method, a computer-readable medium, and a recording apparatus that allow a recording medium for recording to be carried at a high carrying precision.

A main invention is a recording method described below.

A recording method comprises:

a step of changing a carry command value, when carrying a recording medium, according to a state of bending of the recording medium that is carried;

a step of carrying the recording medium based on the carry command value that has been changed; and a step of recording on the recording medium that has been carried.

Features of the present invention other than the above will become clear by the accompanying drawings and the following description.

BRIEF DESCRIPTION OF THE DRAWINGS

For a more complete understanding of the present invention and the advantages thereof, reference is now made to the following description taken in conjunction with the accompanying drawings.

FIG. 5 is a diagram showing an example of a correction data table.

DETAILED DESCRIPTION OF THE INVENTION

Figure 1:
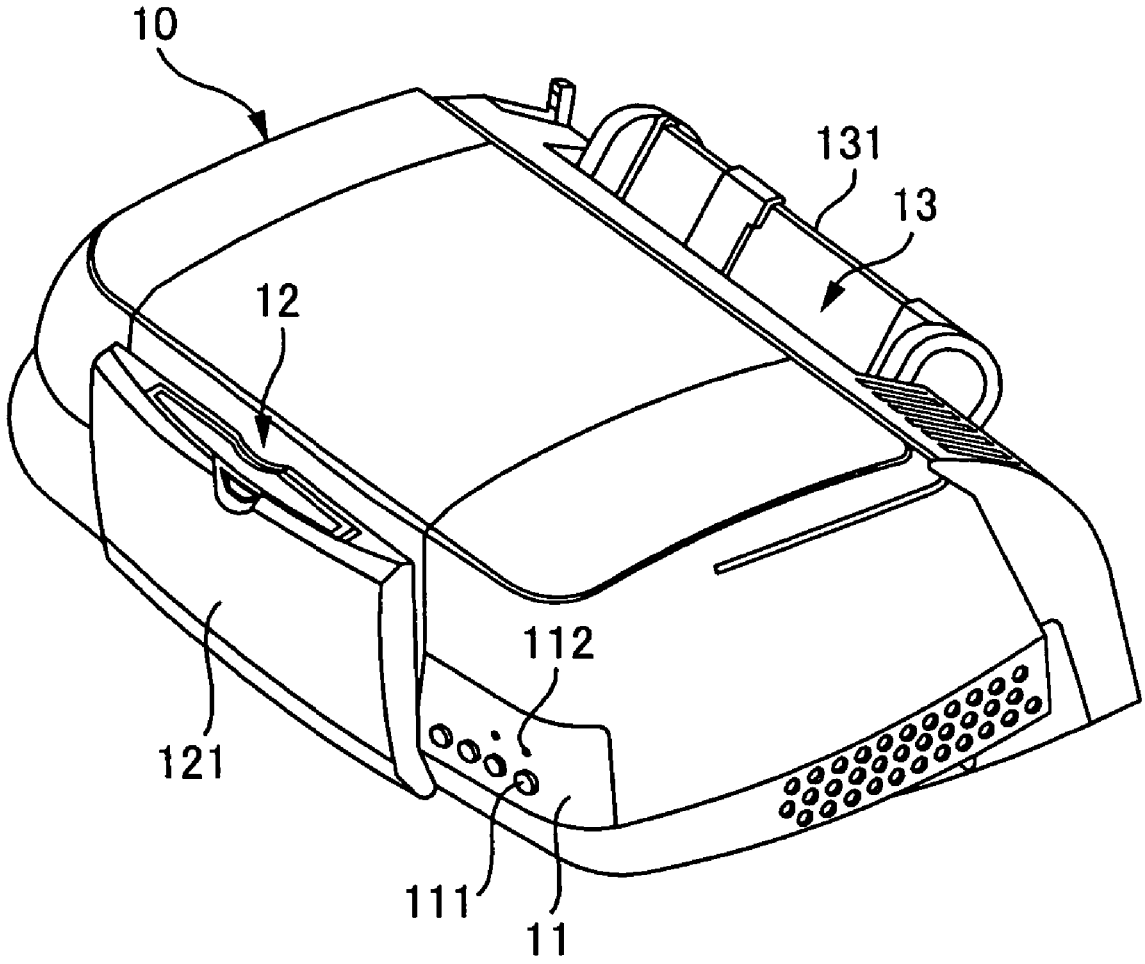
FIG. 1 is a diagram showing the external appearance of an inkjet printer according the present embodiment.

At least the following matters will be made clear by the explanation in the present specification and the description of the accompanying drawings.

A recording method comprises:

a step of changing a carry command value, when carrying a recording medium, according to a state of bending of the recording medium that is carried;

a step of carrying the recording medium based on the carry command value that has been changed; and a step of recording on the recording medium that has been carried.

With this recording method, the carry command value is changed according to the state of the bending of the recording medium, which makes it possible for the recording medium to be carried by a carry command value that takes into account the error in the carry amount that occurs due to bending of the recording medium. Thus, the precision with which the recording medium is carried can be improved.

It is preferable that the carry command value is changed based on an aggregate carry amount that corresponds to changes in the state of bending.

With this recording method, the state of bending in the recording medium is clearly expressed as the aggregate carry amount, which makes it possible for the recording medium to be carried at a carry command value that corresponds to the state of bending.

It is also preferable that the carry command value is changed when a front end region of the recording medium is carried and when a rear end region of he recording medium is carried.

With this recording method, the recording medium can be carried with high precision by changing the carry command value in the front end and rear end regions of the recording medium, where error easily occurs in the carry amount due to bending of the recording medium.

It is further preferable that when the front end region is carried, the carry command value is changed to a larger carry command value than when the rear end region is carried.

With this recording method, the carry command value at the front end side of the recording medium, to which external force acts in such a direction as to return the recording medium, is made larger than the carry command value for the rear end side, to which external force is applied in the direction in which the recording medium is delivered, thereby allowing the carrying precision of the recording medium as a whole to be increased.

It is further preferable that the carry command value is changed according to an attribute of the recording medium.

With this recording method, the carry amount can be suitably adjusted in accordance with an attribute of the recording medium, which makes it possible to realize carrying at high precision regardless of differences in the attribute of the recording medium.

It is also possible for the attribute of the recording medium to be the thickness of the recording medium.

With this recording method, the carry amount can be suitably adjusted in accordance with the rebound force, which differs depending on the thickness of the recording medium, thereby making it possible to realize carrying at high precision regardless of differences in the thickness of the recording medium.

It is also possible that the attribute of the recoding medium to be the length of the recording medium.

With this recording method, the carry amount can be suitably adjusted in accordance with the rebound force, which differs depending on the length of the recording medium, thereby making it possible to realize carrying at high precision regardless of differences in the length of the recording medium.

It is also possible for the attribute of the recoding medium to be the width of the recording medium.

With this recording method, the carry amount can be suitably adjusted in accordance with the rebound force, which differs depending on the width of the recording medium, thereby making it possible to realize carrying at high precision regardless of differences in the width of the recording medium.

It is also possible for the attribute of the recoding medium to be the material of the recording medium.

With this recording method, the carry amount can be suitably adjusted in accordance with the rebound force, which differs depending on the material of the recording medium, thereby making it possible to realize carrying at high precision regardless of differences in the material of the recording medium.

Also, the carry command value is set according to a predetermined reference carry command value, and a correction value for the reference carry command value, wherein the correction value is associated in a data table with an aggregate carry amount of the recording medium and an attribute of the recording medium.

With this recording method, a data table is set for each predetermined carry amount, thereby making it possible for the recording medium to be carried with high precision without performing more detailed and complicated controls than necessary.

Also, a recording method comprises:

a step of changing a carry command value when carrying a front end region of a recording medium and when carrying a rear end region of the recording medium, based on a predetermined reference carry command value, and a data table indicating correction values for the predetermined reference carry command value, the correction values being set in association with a thickness, a length, a width, and a material of the recording medium and being set for every predetermined carry amount of the recording medium;

a step of making a carrying mechanism for carrying the recording medium carry the recording medium based on the carry command value that has been changed; and a step of recording on the recording medium that has been carried.

With this recording method, it is possible to carrying a recording medium with high precision using simple controls.

Also, a computer-readable medium for making a recording apparatus for recording on a recording medium that is carried by a carrying mechanism operate, comprises:

a program code for making the recording medium be carried based on a carry command value;

wherein the carry command value is changed, when the recording medium is carried, according to a state of bending of the recording medium that is carried.

With this computer-readable medium, it is possible to control a recoding apparatus in such a manner that the precision with which the recording medium is carried is increased.

Also, a recording apparatus for recording on a recording medium comprises:

a carrying mechanism for carrying the recording medium, wherein the carrying mechanism carries the recording medium based on a carry command value;

wherein the carry command value is changed according to a state of bending of the recording medium that is carried.

With this recording apparatus, by changing the carry command value according to the state of the bending of the recording medium, it becomes possible for the recording medium to be carried by a carry command value that takes into account the error in the carry amount that occurs due to bending of the recording medium. Thus, the precision with which the recording medium is carried can be increased.

Here, the recording apparatus is not limited to a printing apparatus such as an inkjet printer illustrated in the background art, and may also be a laser printer, for example. The recording apparatus is also not limited to a printing apparatus, and may be any apparatus that is capable of recording on a recording medium, such as a color filter manufacturing device, a dyeing device, a fine processing device, a semiconductor manufacturing device, a surface processing device, a three-dimensional shape forming machine, a liquid vaporizing device, an organic EL manufacturing device (particularly macromolecular EL manufacturing devices), a display manufacturing device, a film formation device, and a DNA chip manufacturing device. Thus, the recording agent for recording on a recording medium is not limited to dye ink or pigment ink, and it is also possible to use a recording agent such as toner, as well as, for example, liquid (including water) including metallic material, organic material (particularly macromolecular material), magnetic material, conductive material, wiring material, film-formation material, electronic ink, process liquid, or genetic solutions. With such a recording apparatus, it is possible to achieve a reduction in material, process steps, and costs in many industrial fields.

Also a recording method comprises:

a step of changing a carry command value when carrying a front end region of a recording medium and when carrying a rear end region of the recording medium;

a step of making a carrying mechanism for carrying the recording medium carry the recording medium based on the carry command value that has been changed; and a step of recording on the recording medium that has been carried.

With this recording method, it is possible to carry especially a front end region and an rear end region of a recording medium with high precision using simple control.

Overview of the Recording Apparatus (Inkjet Printer)

In this embodiment, an inkjet printer for printing by ejecting ink onto paper, which is an example of a recording medium, is described as an example of a recording apparatus suited for the present invention.

<Regarding the Configuration of the Inkjet Printer>

FIG. 1 is a diagram showing the external appearance of a color inkjet printer according the present embodiment.

A color inkjet printer (hereinafter, also referred to as "printer") 10 is a printer that is capable of printing color images, and, for example, is an inkjet-type printer that forms images by ejecting six different color inks, such as cyan (C), magenta (M), yellow (Y), black (K), light cyan (LC), and light magenta (LM), onto a recording medium, including roll paper, to form dots thereon. It should be noted that for the color ink, it is also possible to use dark yellow (DY) in addition to the six colors mentioned above.

As shown in FIG. 1, the printer 10 is provided with a structure for discharging from its front side a recording medium such as print paper that is supplied from its rear side. On its front surface, the printer 10 is provided with a control panel 11 and a paper discharge section 12, and on its rear side it is provided with a paper supply section 13. The control panel 11 is provided with various types of control buttons 111 and display lamps 112. The paper discharge section 12 is provided with a paper discharge tray 121 that covers the paper discharge opening when the printer is not in use. The paper supply section 13 is provided with a paper supply tray 131 for holding cut paper (not shown) and a paper supply guide for guiding the paper that is supplied. It should be noted that the printer 10 is provided with a paper supply structure that is capable of printing not only on recording media in single sheets, such as cut paper, but also on recording media that are continuous, such as roll paper.

Internal Configuration of the Printer 10

Figure 2:
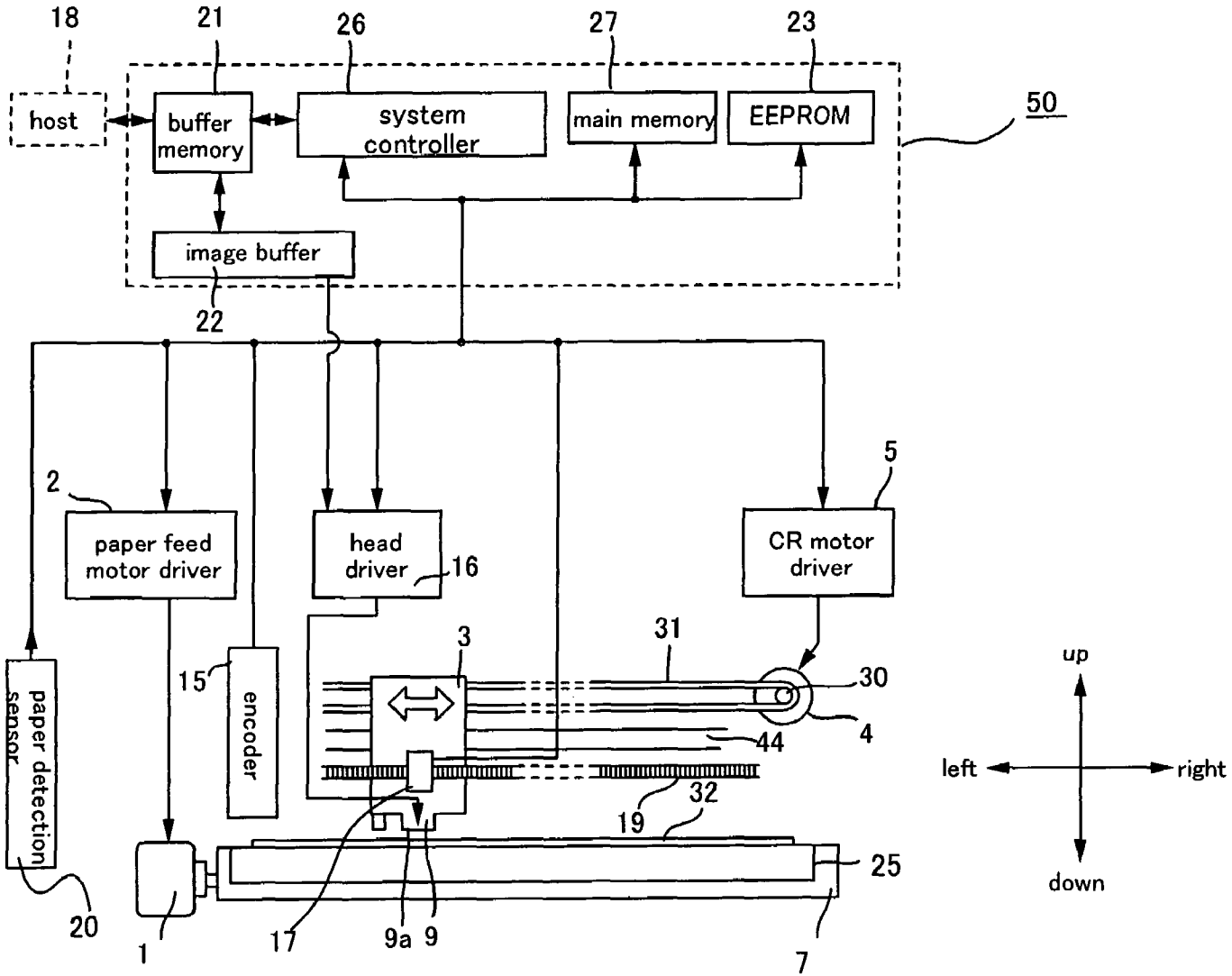
FIG. 2 is a diagram showing the internal configuration of the printer according to the present embodiment.
Figure 3:
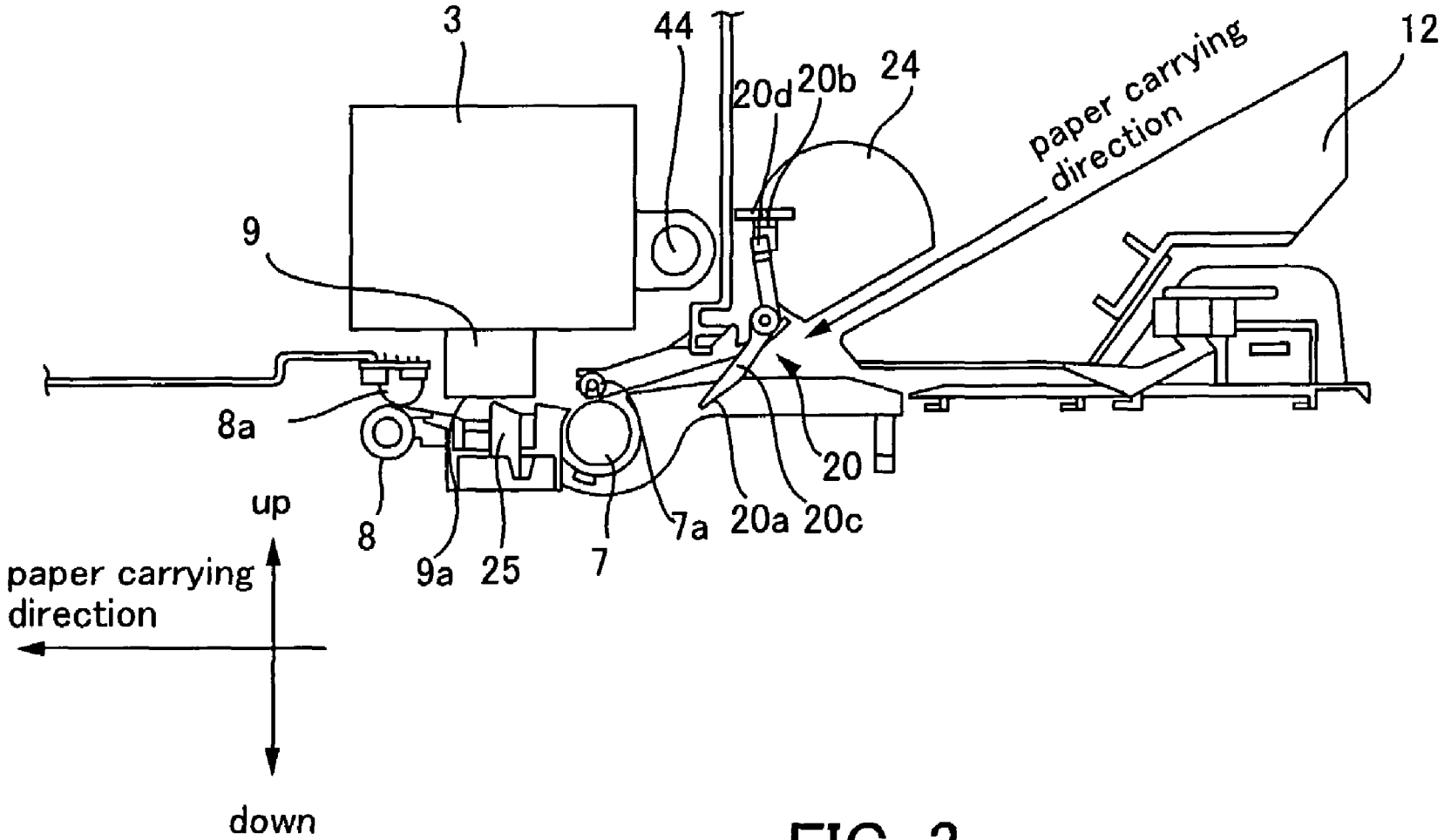
FIG. 3 is an explanatory diagram showing the arrangement around a print head.
Figure 4:
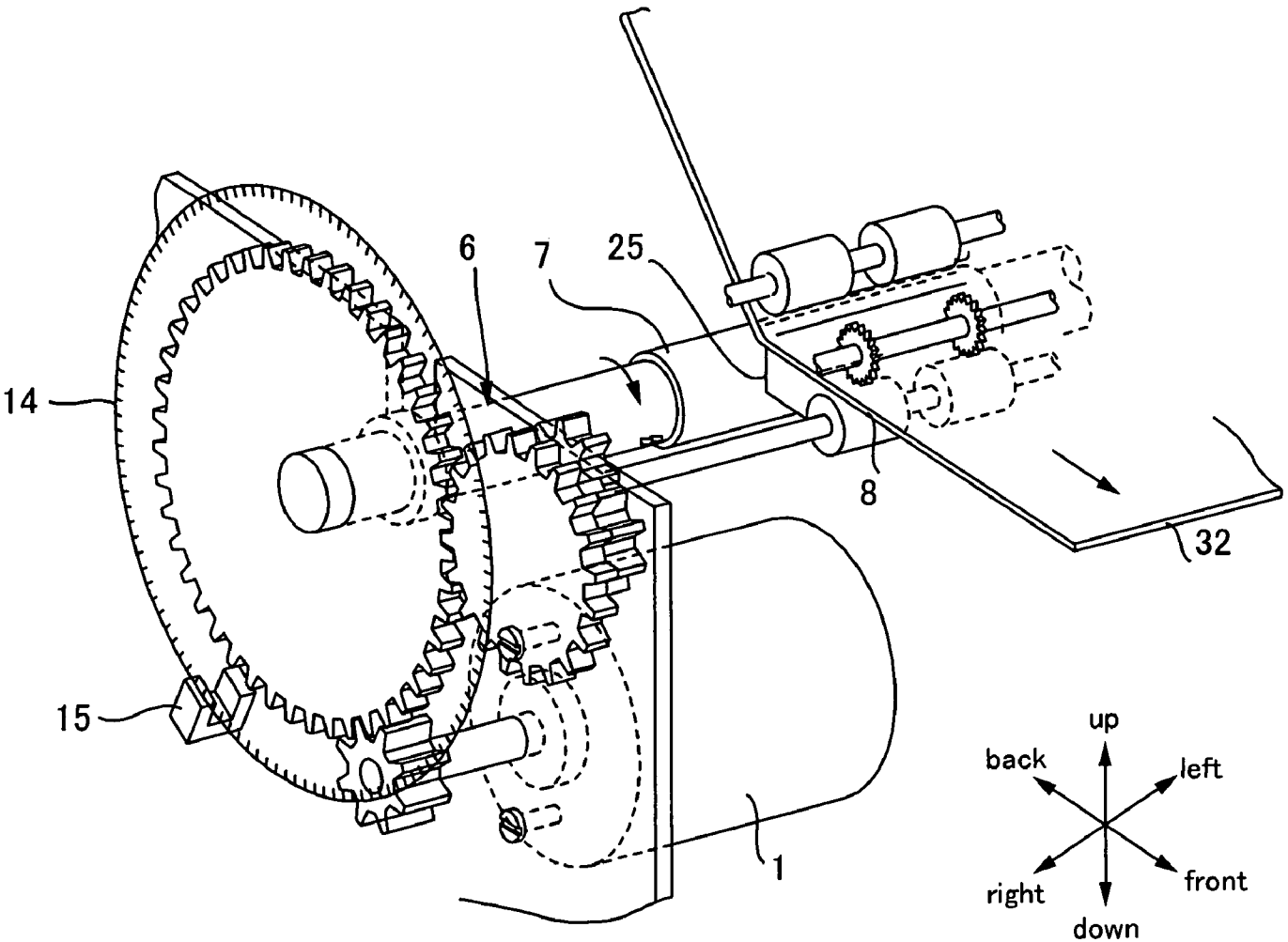
FIG. 4 is an explanatory diagram for describing a drive section of a print paper carrying mechanism.

Next, the internal configuration of the printer 10 is described with reference to FIG. 2 to FIG. 4. FIG. 2 is a diagram showing the internal configuration of the printer 10 according to this embodiment, FIG. 3 is an explanatory diagram showing the arrangement around a print head 9, and FIG. 4 is an explanatory diagram for describing a drive section of a print paper carrying mechanism.

As shown in the diagrams, the printer 10 has a mechanism for ejecting ink and forming dots by driving the print head 9, which is mounted in/on a carriage 3, a mechanism for making the carriage 3 move back and forth in the direction that is perpendicular to the direction in which print paper is carried by a carriage motor 4, a paper carrying mechanism for carrying a print paper 32 supplied by a paper supply roller 24 from the paper supply tray 131 (see FIG. 1) by a paper feed motor (hereinafter, also referred to as "PF motor") 1, and a control circuit 50.

The mechanism for ejecting ink and forming dots is provided with the print head 9, which has a plurality of nozzles serving as ink ejection sections, and a head driver 16 for driving the print head 9, and makes predetermined nozzles eject ink based on print command signals. In a lower surface 9*a* of the print head 9, a plurality of nozzles are formed in rows in the carrying direction of the print paper 32, and a plurality of these rows are provided in the direction perpendicular to the carrying direction of the print paper 32. The print head 9 and the nozzle arrangement will be discussed in greater detail later.

The mechanism for moving the carriage 3 back and forth is made of the carriage motor (hereinafter, also referred to as the "CR motor") 4 for driving the carriage 3, a CR motor driver 5 for driving the carriage motor 4, a slide shaft 44 that is provided extending in the direction perpendicular to the carrying direction of the print paper 32 and that slidably holds the carriage 3, a linear encoder 17 that is fastened to the carriage 3, a linear encoder code plate 19 in which slits are formed at a predetermined spacing, a pulley 30 attached to the rotational shaft of the carriage motor, and a timing belt 31 that is driven by the pulley 30.

The print head 9 and a cartridge mount section that is provided in a single unit with the print head 9 are fastened to the carriage 3. In the cartridge mount section are mounted ink cartridges each accommodating ink, such as black (K), cyan (C), magenta (M), and yellow (Y) ink.

The paper carrying mechanism for carrying the print paper 32 that is supplied from the paper supply tray 131 has: a platen 25 that is arranged in opposition to the print head 9 and that serves as a guide member for guiding the print paper 32 so that the print paper 32 and the print head 9 are at a suitable distance from one another; a carry roller 7 that is provided on the upstream side in the carrying direction of the print paper 32 with respect to the platen 25 and that carries the supplied print paper 32 in such a manner that it is in contact with the platen 25 at a predetermined angle; a paper discharge roller 8 that is provided on the downstream side in the carrying direction of the print paper 32 with respect to the platen 25 and that is for carrying the print paper 32 that has been released from the carry roller 7 and discharging it; the PF motor 1 for driving the carry roller 7 and the paper discharge roller 8; a paper feed motor driver 2 for driving the PF motor 1; a rotary encoder 15 for detecting the amount that the print paper 32 has been carried; and a paper detection sensor 20 for detecting whether or not there is a print paper 32 and for detecting the front end and the rear end of the print paper 32. The encoders 15 and 17 are discussed in detail later.

The PF motor 1 is driven by the paper feed motor driver 2 based on a carry command value. The carry command value is set in accordance with a predetermined reference carry command value, which will be discussed later, and a correction value that is obtained from a correction data table, which will be discussed later.

The carry roller 7 is provided below the carry route of the print paper 32, and above it is provided a driven roller 7*a* for holding the print paper 32 in opposition to the carry roller 7. The paper discharge roller 8 is also provided below the carry route of the print paper 32, and above it is provided a driven roller 8*a* for holding the print paper 32 in opposition to the paper discharge roller 8. However, the driven roller 8*a* in opposition to the paper discharge roller 8 is a roller that is configured as a thin plate wherein fine teeth are formed in the outer periphery thereof, so that ink is kept from rubbing up against it even if it comes into contact with the surface of the print paper 32 after printing.

To reduce the area occupied by the printer 10, the paper supply tray 131 is provided on the rear side of the printer at a large oblique angle so that the paper 32 is set in a substantially upright position. On the other hand, the paper discharge section is provided on the front side of the printer so that the paper that is discharged after printing can be received easily by the user, and is configured in such a manner than the paper is ejected substantially horizontally. Consequently, the paper 32 is significantly bent inside the printer 10 as it is carried, as was mentioned earlier.

The position where the carry roller 7 and the print paper 32 contact one another is arranged higher than the position where the platen 25 and the print paper 32 contact one another, and a print paper 32 that has been carried from the carry roller 7 contacts the platen 25 at a predetermined angle and is carried further, so that the print paper 32 is carried along and over the platen 25. In other words, the print paper 32 can be brought into abutment with the platen 25 at a predetermined angle in such a manner that it is pushed against the platen 25, and therefore good images can be obtained by keeping the print paper 32 in a suitable position from the nozzles by the platen 25. The platen 25 and the paper discharge roller 8 are arranged in such a way that the print paper 32 that is carried over the platen 25 is naturally guided toward the paper discharge roller 8.

Also, the carry roller 7 and the paper discharge roller 8 are linked by a gear column 6, rotated by the rotation of the PF motor 1 that is transferred thereto, and the speed at which both rollers 7 and 8 carry the print paper 32 is made to match.

The paper detection sensor 20 is provided upstream of the carry roller 7 in the carrying direction, and is made of a lever 20*a* having a rotation center at a position higher than the carry route of the print paper 32, and a transmission-type sensor 20*b* provided above the lever 20*a* and that has a light emitting section and a light receiving section. The lever 20*a* is constituted by an action section 20*c* that is arranged so that it hangs into the carry route under its own weight and that is made to rotate by the print paper 32 that is supplied from the paper supply tray 131, and a light-blocking section 20*d* that is positioned opposite the action section 20*c*, sandwiching the rotation center between them, and that is provided in such a manner than it passes between the light emitting section and the light receiving section. The paper detection sensor 20 detects that the print paper 32 has arrived at a predetermined position because the light-blocking section 20*d* blocks the light that is emitted by the light emitting section when the lever 20*a* is pressed by the supplied print paper 32 and the print paper 32 arrives at the predetermined position. Then, when the print paper 32 is carried by the carry roller 7 and the rear end of the print paper 32 passes the paper detection sensor 20, the lever 20*a* hangs down under its own weight and the light-blocking section 20*d* is removed from between the light emitting section and the light receiving section, and thereby the light from the light emitting section is received by the light receiving section and the paper detection sensor 20 detects that the rear end of the print paper 32 has arrived at the predetermined position. Consequently, it is detected that the print paper 32 is on the carry route during the period that the light-blocking section 20*d* blocks the light from the light emitting section.

Internal Structure of the Control Circuit 50

The control circuit 50 is provided with a buffer memory 21 that receives signals that are supplied from a host computer 18, an image buffer 22 for storing print data, a system controller 26 for controlling the overall operations of the printer 10, a main memory 27, and an EEPROM 23. Print data that are transferred are temporarily stored in the buffer memory 21. When a print command signal is received from the control panel 11 of the printer 10 or the host computer 18 connected to the printer 10, then, in the printer 10, the print data that are transmitted together with the print command signal are temporarily stored in the buffer memory 21 and the system controller 26 reads necessary information from the print data of the buffer memory 21, and based on this information, sends control signals to the CR motor driver 5, the PF motor driver 2, and the head driver 10. Print data for the plurality of color components that are received by the buffer memory are stored in the image buffer. The head driver 16 reads print data of the various color components from the image buffer 22 according to control signals from the system controller 26, and in accordance with these data, drives the various color nozzles that are provided in the print head 9.

The EEPROM 23 stores a correction data table for correcting the carry error of the paper due to the state of bending of the paper 32, which is described later.

Description of the Correction Data Table

FIG. 5 shows an example of the correction data table. This correction data table shows correction values serving as the correction amounts that are set incrementally according to the aggregate carry amount of the paper and that are for correcting the carry amount when carrying up to a predetermined aggregate carry amount. More specifically, five correction data tables, for A4 size thin paper, A4 size thick paper, A3 size thin paper, postcard, and A4 size OHP sheets, are stored. With regard to these correction data tables, the corresponding data table is referred to according to the recording medium designated by the user; however, if there is a means for detecting the type of recording medium, then it is also possible for the corresponding data table to be referenced automatically according to the recording medium that has been supplied.

A4 thin paper is taken as an example in the following description. In the correction data table for A4 thin paper, the correction values are set in a stepwise manner for each one-inch increment of the aggregate carry amount from the front end of the paper. In this example, '1' is added to the reference carry command value when carrying from the front end up to two inches, and '1' is subtracted from the reference carry command value when carrying at two inches from the rear end. In other words, after carrying two inches from the front end, the paper is carried by the reference command value in the region where the correction value is '0' as the paper is carried up to the position where the aggregate carry amount is eight inches. Here, a correction value of "1" corresponds to, for example, 1/5760 inch, and when carrying the region from the front end to two inches, the PF motor 1 is driven based on a carry command value obtained by adding a carry amount of 1/5760 inch to the reference carry amount by which the paper is carried at the reference command value. Also, when carrying the region of two inches on the rear end side, the PF motor 1 is driven based on a carry command value obtained by subtracting a carry amount of 1/5760 inch from the reference carry amount. In each of the correction data tables provided for each type of recording medium, appropriate correction values are set corresponding to factors, such as the thickness, length, width, and material of the recording medium, that influence the rebound force that is generated when the recording medium is bent. It should be noted that the correction values of the data tables are set in advance based on data that are obtained through experimentation, for example, so that the carry amount is suitable for the type of medium to be printed.

Regarding the Configuration of the Nozzles

Figure 6:
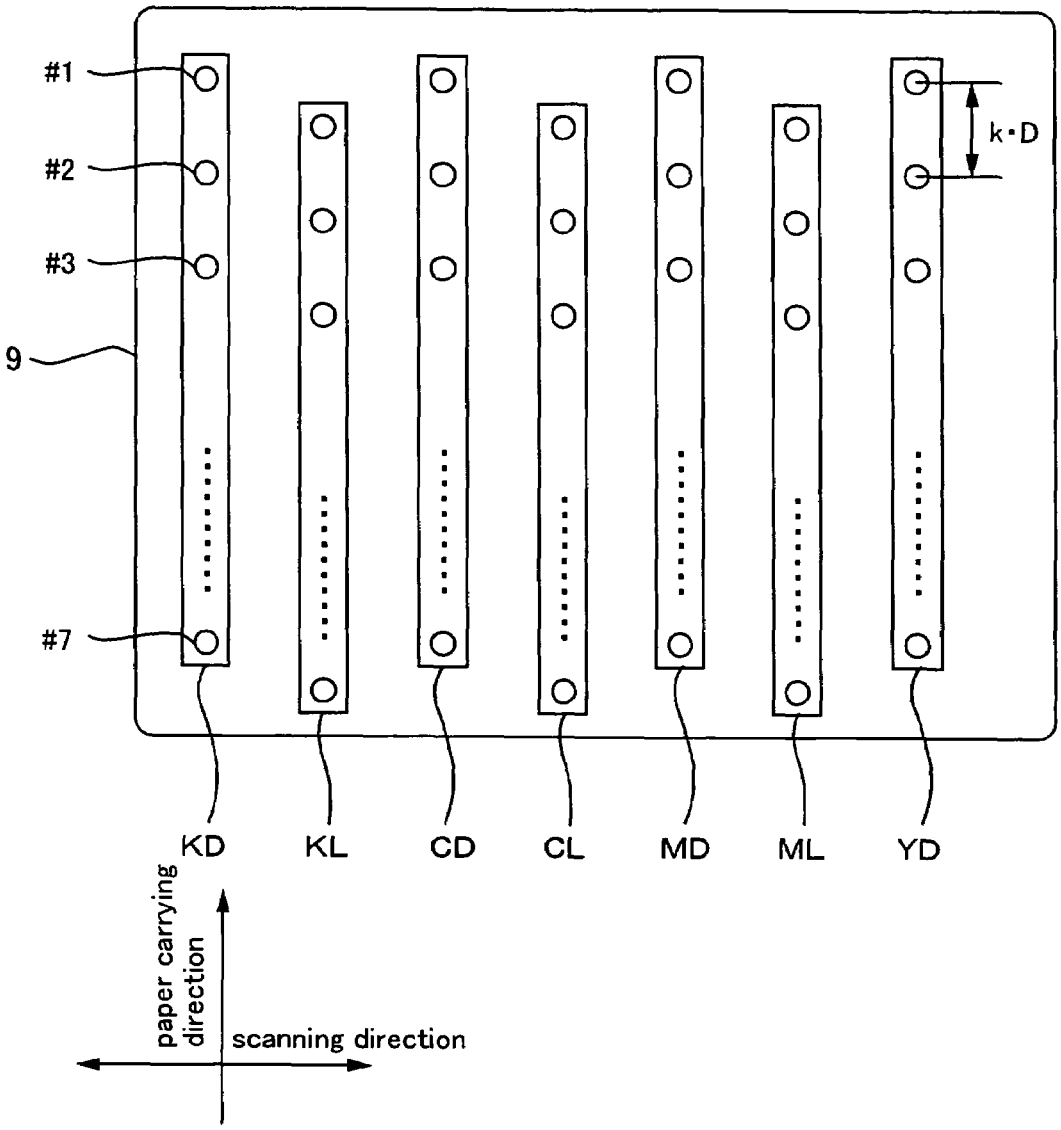
FIG. 6 is an explanatory diagram showing the arrangement of nozzles in the lower surface of the print head.

FIG. 6 is an explanatory diagram showing the arrangement of the nozzles in the lower surface 9*a* of the print head 9.

In the lower surface of the print head 9*a* are provided a dark black ink nozzle group $K_D$, a light black ink nozzle group $K_L$, a dark cyan ink nozzle group $C_D$, a light cyan ink nozzle group $C_L$, a dark magenta ink nozzle group $M_D$, a light magenta nozzle group $M_L$, and a yellow ink nozzle group $Y_D$. Each nozzle group is provided with a plurality (in this embodiment, seven) of nozzles, which are ejection openings for ejecting ink of each color. It should be noted that the first alphabet letter in the reference characters indicating the nozzle groups represents the ink color, whereas the accompanying letter "$_D$" means that the ink is of relatively high darkness and the accompanying letter "$_L$" means that the ink is of relatively low darkness.

The plurality of nozzles of the nozzle groups are arranged at a constant spacing (nozzle pitch: k·D) in the paper carrying direction. Here, D is the minimum dot pitch in the paper carrying direction (that is, the spacing of the dots formed on the paper at the highest resolution). For example, if this resolution is 720 dpi, then the spacing is 1/720 inch (approximately 35.3 μm). Also, k is an integer of 1 or more.

The nozzles of the nozzle groups are assigned numbers that become smaller toward the downstream side (N1 to N7). Also, as regards their positions in the paper carrying direction, the nozzles of each nozzle group are provided so that they are positioned between the nozzles of adjacent nozzle groups. For example, the first nozzle N1 of the light black ink nozzle group $K_L$ is provided between the first nozzle N1 and the second nozzle N2 of the dark black ink nozzle group $K_D$, as regards its position in the paper carrying direction. Each nozzle is provided with a piezo element (not shown) as a drive element for driving the nozzle and making it eject ink droplets.

It should be noted that during printing, the print paper 32 is carried intermittently by the carry roller 7 and the paper discharge roller 8 by a predetermined carry amount F, and between these intermittent carries, the carriage 3 is moved in the scanning direction and ink droplets are ejected from the nozzles.

Encoders

Figure 7:
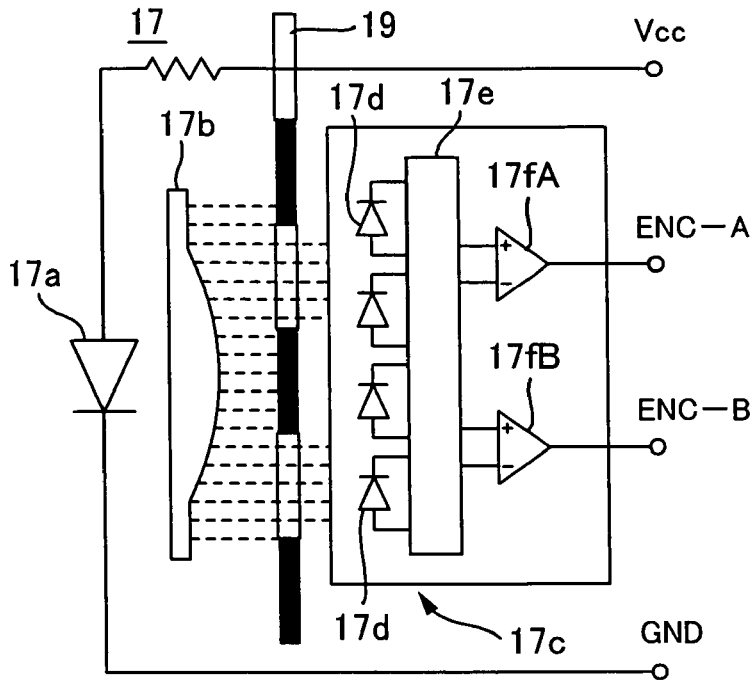
FIG. 7 is a explanatory diagram of the configuration of a linear encoder.

Next, the linear encoder 17 attached to the carriage 3 and the rotary encoder 15 for the PF motor 1 are described. FIG. 7 is an explanatory diagram that schematically shows the configuration of the linear encoder 17 attached to the carriage 3.

The encoder 17 shown in FIG. 7 has a light-emitting diode 17*a*, a collimating lens 17*b*, and a detection processing section 17*c*. The detection processing section 17*c* has a plurality (for instance, four) photodiodes 17*d*, a signal processing circuit 17*e*, and for example two comparators 17*f*A and 17*f*B.

The light-emitting diode 17*a* emits light when a voltage Vcc is applied to it via resistors on both sides. This light is condensed into parallel light by collimating lens 17*b* and passes through the code plate 19. The code plate 19 is provided with slits at a predetermined spacing (for example, 1/180 inch (1 inch=2.54 cm).

The parallel light that passes through the code plate 19 then passes through stationary slits (not shown) and is incident on the photodiodes 17*d*, where it is converted into electrical signals. The electrical signals that are output from the four photodiodes 17*d* are subjected to signal processing in the signal processing circuit 17*e*, and the signals that are output by the signal processing circuit 17*e* are compared in the comparators 17*f*A and 17*f*B, and the results of these comparisons are output as pulses. The pulse ENC-A and the pulse ENC-B that are output from the comparators 17*f*A and 17*f*B become the output of the encoder 17.

Figure 8A:
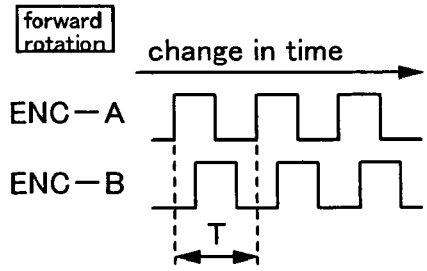
FIG. 8A is a timing chart showing the waveforms of the two output signals of an encoder when a CR motor is rotating forward.
Figure 8B:
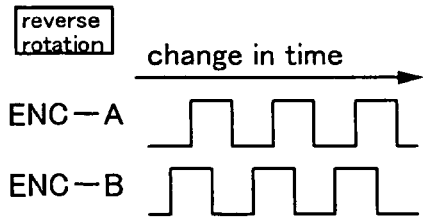
FIG. 8B is a timing chart showing the waveforms of the two output signals of the encoder when the CR motor is rotating in reverse.

FIG. 8A is a timing chart of the waveforms of the two output signals of the encoder when the CR motor is rotating forward. FIG. 8B is a timing chart of the waveforms of the two output signals of the encoder when the CR motor is rotating in reverse.

As shown in FIG. 8A and FIG. 8B, the phases of the pulse ENC-A and the pulse ENC-B are misaligned by 90 degrees both when the CR motor is rotating forward and when it is rotating in reverse. When the CR motor 4 is rotating forward, that is, when the carriage 3 is moving in the main-scanning direction, then, as shown in FIG. 8A, the phase of the pulse ENC-A leads the phase of the pulse ENC-B by 90 degrees. On the other hand, when the CR motor 4 is rotating in reverse, then, as shown in FIG. 8B, the phase of the pulse ENC-A is delayed by 90 degrees with respect to the phase of the pulse ENC-B. A single period T of the pulse ENC-A and ENC-B is equivalent to the amount of time during which the carriage 3 is moved by the slit spacing of the code plate 12.

On the other hand, the rotary encoder 15 for the PF motor 1 has substantially the same configuration as the linear encoder 17, except that the rotary encoder code plate 14 is a rotation disk that rotates in conjunction with rotation of the PF motor 1. The rotary encoder 15 outputs the two output pulses ENC-A and ENC-B. In the inkjet printer, the slit spacing of the plurality of slits provided in the rotary encoder code plate 14 is 1/180 inch, and when the PF motor 1 is rotated by one slit spacing, the paper is fed by 1/1440 inch. Consequently, by multiplying the count value of the output of the rotary encoder 15 by 1/1440 inch, the amount that the print paper 32 is carried can be detected.

With respect to the carry amount of the print paper 32, the output of the rotary encoder 15 is counted after the print paper 32 arrives at a predetermined print start position, and the carry amount is calculated from this counted value and stored on the memory of the control circuit 50 as the aggregate carry amount of the print paper 32.

Relationship Between the Extent of Bending When Carrying the Paper and the Picture Quality (Reference Example)

<If the Paper Is Not Bent>

Figure 9:
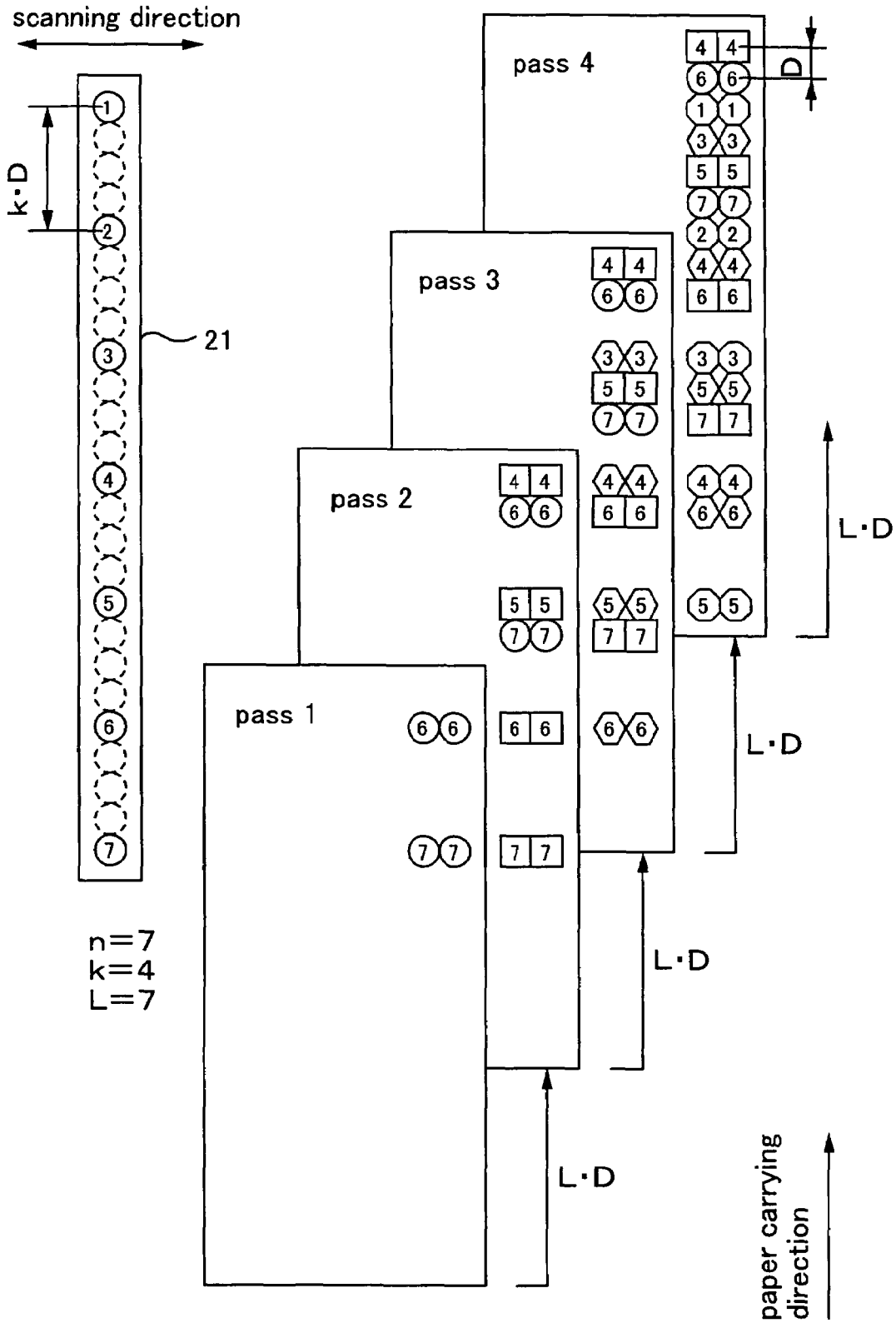
FIG. 9 is an explanatory diagram showing how dots are formed when the paper is carried horizontally without being bent.

FIG. 9 is an explanatory diagram showing how dots are formed when the paper 32 is carried horizontally without being bent (that is, if the actual carry amount matches the ideal carry amount by which carrying is performed according to the reference carry command value). In the diagram, for the sake of simplifying the description, the print head 9 has only seven nozzles for a single color (that is, n=7). Also, in the diagram, for the sake of simplifying the description, the paper 32 is illustrated in such a manner that it appears as if it also moves in the scanning direction, but in practice the paper 32 moves only in the paper carrying direction and does not move in the scanning direction.

In the diagram, the nozzle pitch k·D of this nozzle group is four times the dot pitch D (that is, k=4). It should be noted that in the print head 9, the numbers 1 to 7 shown in circles represent the nozzle number. As shown in the diagram, the smaller the nozzle number of a nozzle, the more downstream in the paper carrying direction that the nozzle is provided.

After the nozzles are moved for a single scan (hereinafter, this is referred to as a "pass") in the scanning direction, the paper 32 is moved by the paper carrying mechanism in a stepwise manner in the paper scanning direction by a carry amount F=L·D (L is an integer, and D is the dot pitch) based on the reference carry command value. At this time, since the paper 32 is not bent, outside force due to bending does not act on the paper, and it is carried by the paper carrying mechanism at a carry amount 7·D (that is, L=7), which matches the target carry amount. It should be noted that if the paper 32 is carried by a constant carry amount F (=L·D), then the integer L is preferably a value that yields a remainder of (k−1) when it is divided by the integer k.

In the paper 32, the circles indicate the position of the dots (the position of the pixels) formed in the first pass, the squares indicate the position of the dots formed in the second pass, the hexagons indicate the position of the dots formed in the third pass, and the octagons indicate the position of the dots formed in the fourth pass. Also, the numbers within these shapes represent the number of the nozzle that ejects ink in order to form that dot. In the diagram, two dots are formed during each pass; however, in practice, ink is ejected intermittently while the nozzles are moved in the scanning direction, and therefore numerous dots are formed in a line in the scanning direction (hereinafter, this is referred to as a "raster line").

With the recording mode of this diagram, the nozzles record a raster line immediately above the raster line recorded in the pass immediately prior thereto when the paper 32 is carried by the carry amount F in the scanning direction. Consequently, the raster lines are formed at a constant interval in the carrying direction. The recording mode described here is an example of "interlace printing." Interlace printing refers to print modes in which k is at least 2 and raster lines that are not recorded exist between the raster lines that are recorded in a single pass.

<Influence on the Image Due to Bending in the Paper>

Figure 10:
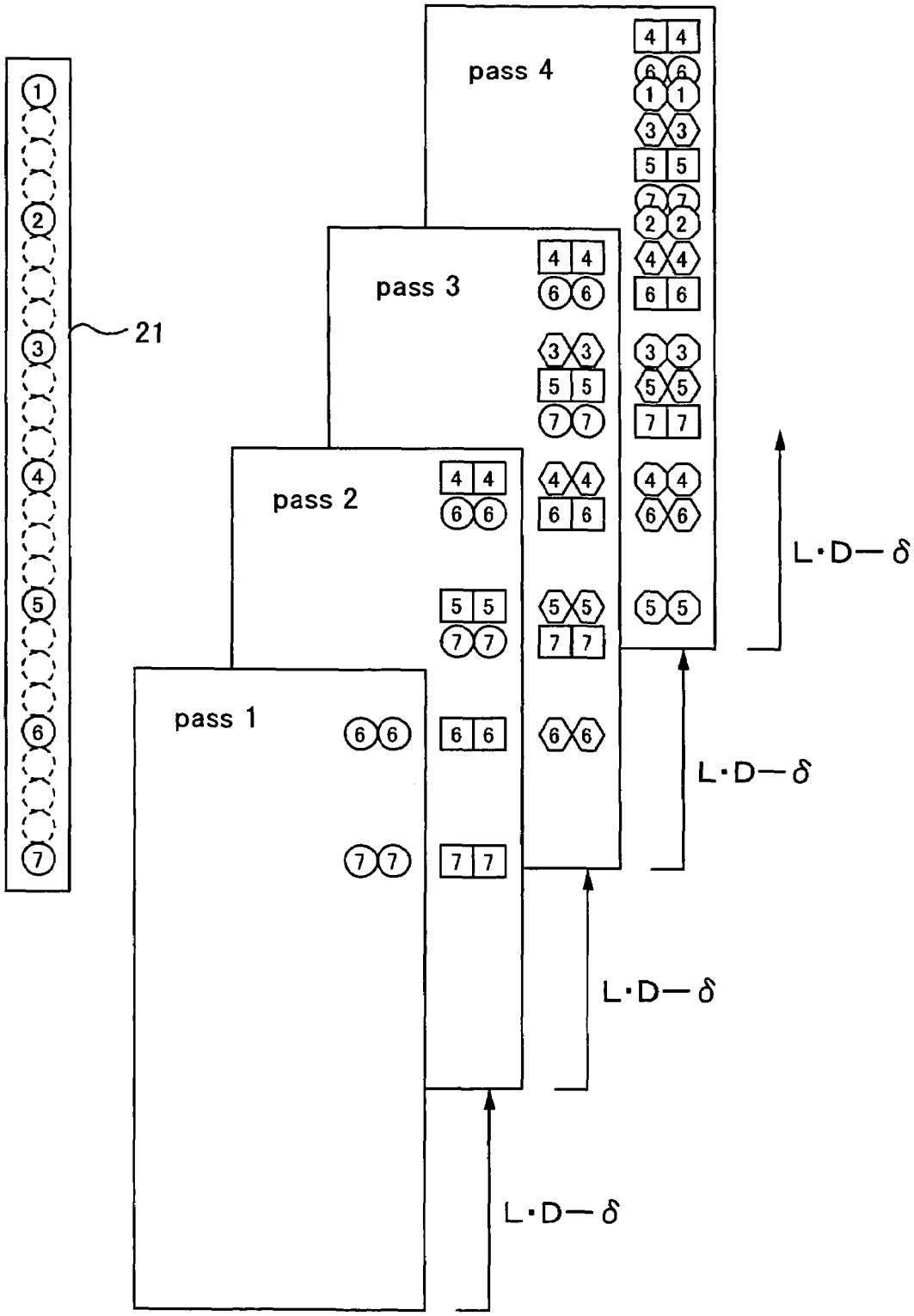
FIG. 10 is a diagram for describing the influence that the bend in the paper has on the positions where dots are formed on the front end side of the paper.
Figure 11:
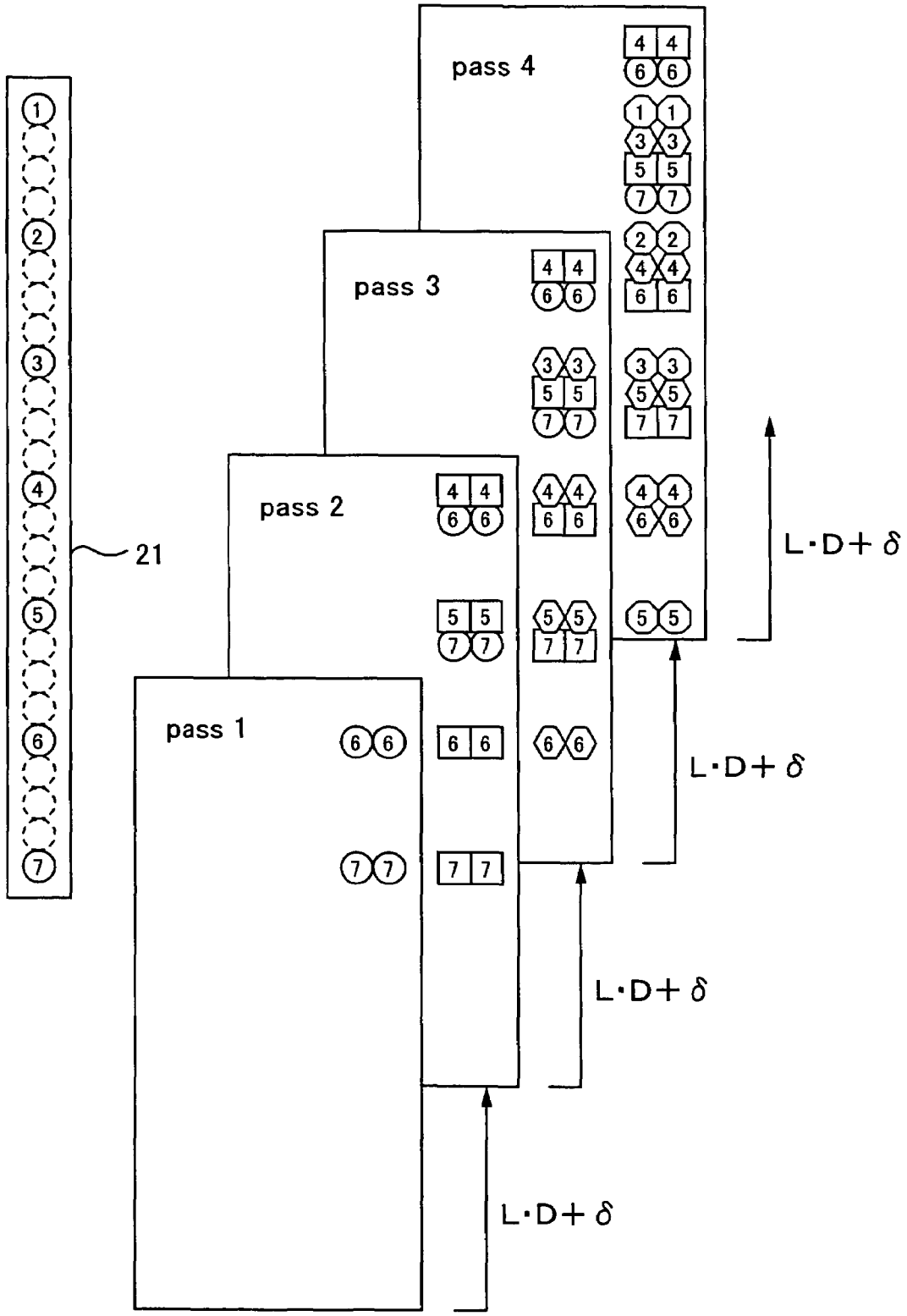
FIG. 11 is a diagram for describing the influence that the bend in the paper has on the positions where dots are formed on the rear end side of the paper.
Figure 12A:
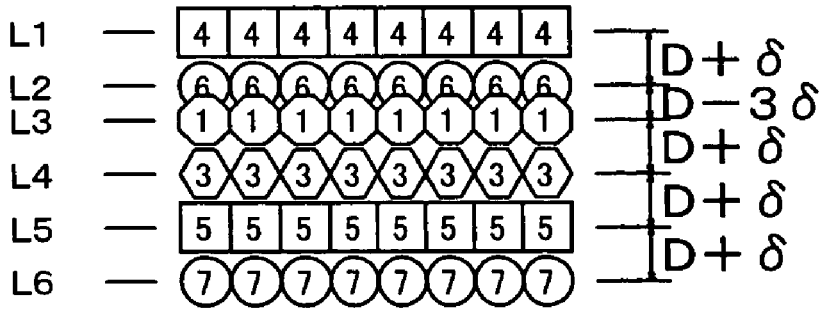
FIG. 12A is a diagram for describing the banding that occurs when carrying with a carry amount that is reduced by the amount of the error δ.
Figure 12B:
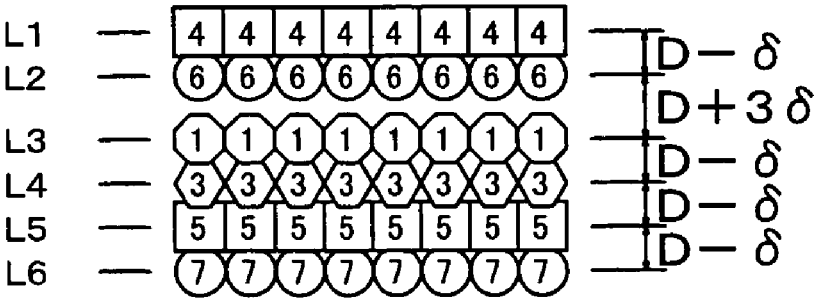
FIG. 12B is a diagram for describing the banding that occurs when carrying with a carry amount that is increased by the amount of the error δ.

FIG. 10 is a diagram for describing the influence that bending in the paper has on the positions where dots are formed on the front end side of the paper 32. FIG. 11 is a diagram for describing the influence that bending in the paper has on the positions where dots are formed on the rear end side of the paper 32. FIG. 12A is an explanatory diagram showing how print stripes (banding) occur in FIG. 10, and FIG. 12B is an explanatory diagram showing how print stripes (banding) occur in FIG. 11.

As mentioned earlier, due to the structure of the printer 10, the paper 32 is significantly bent upstream from the carry roller 7. Therefore, the paper 32 is bent at its front end when the front end region of the paper 32 is carried supported by the carry roller 7. For this reason, when the front end region of the paper 32 is carried, external force acts in such a direction as to return the paper 32 toward the paper supply tray 131 side. At this time, even though the paper was carried based on the reference carry command value for carrying by a target carry amount F, a carry error δ occurs due to this external force, and the actual carry amount becomes (F−δ).

That is, the paper 32 is carried by a carry amount that is less than the carry amount of the case of FIG. 9 by the carry error δ. As a result, the dot pitch between the raster lines (L2, L6) recorded by the seventh and sixth nozzles in pass 1 and the raster lines (L1, L5) recorded by the fifth and fourth nozzles in pass 2 is long by the amount of δ. With respect to the raster lines (L3, L4) that are recorded next, the dot pitch between the raster line recorded in pass 2 and the raster line (L4) recorded in pass 3 is also long by the amount of δ, and the dot pitch between the raster line recorded in pass 3 and the raster line (L3) recorded in pass 4 is long by the amount of δ. As a result of carrying including error in these passes, for example, the dots of the raster line of the second row recorded in pass 1 (L2: the line formed by the sixth nozzle in pass 1) and the raster line of the third row recorded in pass 4(L3: the line formed by the first nozzle in pass 4) overlap one another by an amount of 3δ, as shown in FIG. 12A. Thus, as shown in FIG. 12A, in the front end region of the paper 32, the overlapping area between the raster line of the second row and the raster line of the third row in which dots are recorded overlapping one another is intensified, generating stripes of dark color that are visible to the unaided eye. These stripes of dark color (hereinafter, called "dark banding," although they may also be called "black banding" or "concentrated banding") are observed as a deterioration of picture quality.

On the other hand, when the rear end region of the paper 32 is carried supported by the carry roller 7, the paper 32 is bent at the rear end, resulting in an external force that acts to push the paper 32 toward the paper discharge section 12. Consequently, when carrying based on the reference carry command value, an error δ occurs due to this external force, and the actual carry amount becomes (F+δ).

That is, the paper 32 is carried by a carry amount that is greater than the carry amount of the case of FIG. 9 by the carry error δ. As a result, the raster lines (L2, L6) recorded in pass 1 and the raster lines (L1, L5) recorded in pass 2 are recorded overlapping one another by the amount of δ. With respect to the raster lines (L3, L4) that are recorded next, the raster line recorded in pass 2 and the raster line (L4) recorded in pass 3 overlap by the amount of δ, and the raster line recorded in pass 3 and the raster line (L3) recorded in pass 4 overlap one another by the amount of δ. As shown in FIG. 12B, as a result of carrying including error in these passes, for example, the spacing between the raster line of the second row recorded in pass 1 (L2: the line formed by the sixth nozzle in pass 1) and the raster line of the third row recorded in pass 4 (L3: the line formed by the first nozzle in pass 4) becomes greater than the ideal dot pitch D recorded when carrying by the target carry amount, and the color of the primer (for example, the color white for white paper) appears in this space, generating stripes of light color that are visible to the unaided eye. These stripes of light color (hereinafter, called "bright banding," although they may also be called "white banding" or "light banding") are observed as a deterioration of picture quality.

Printing Operation

Figure 13:
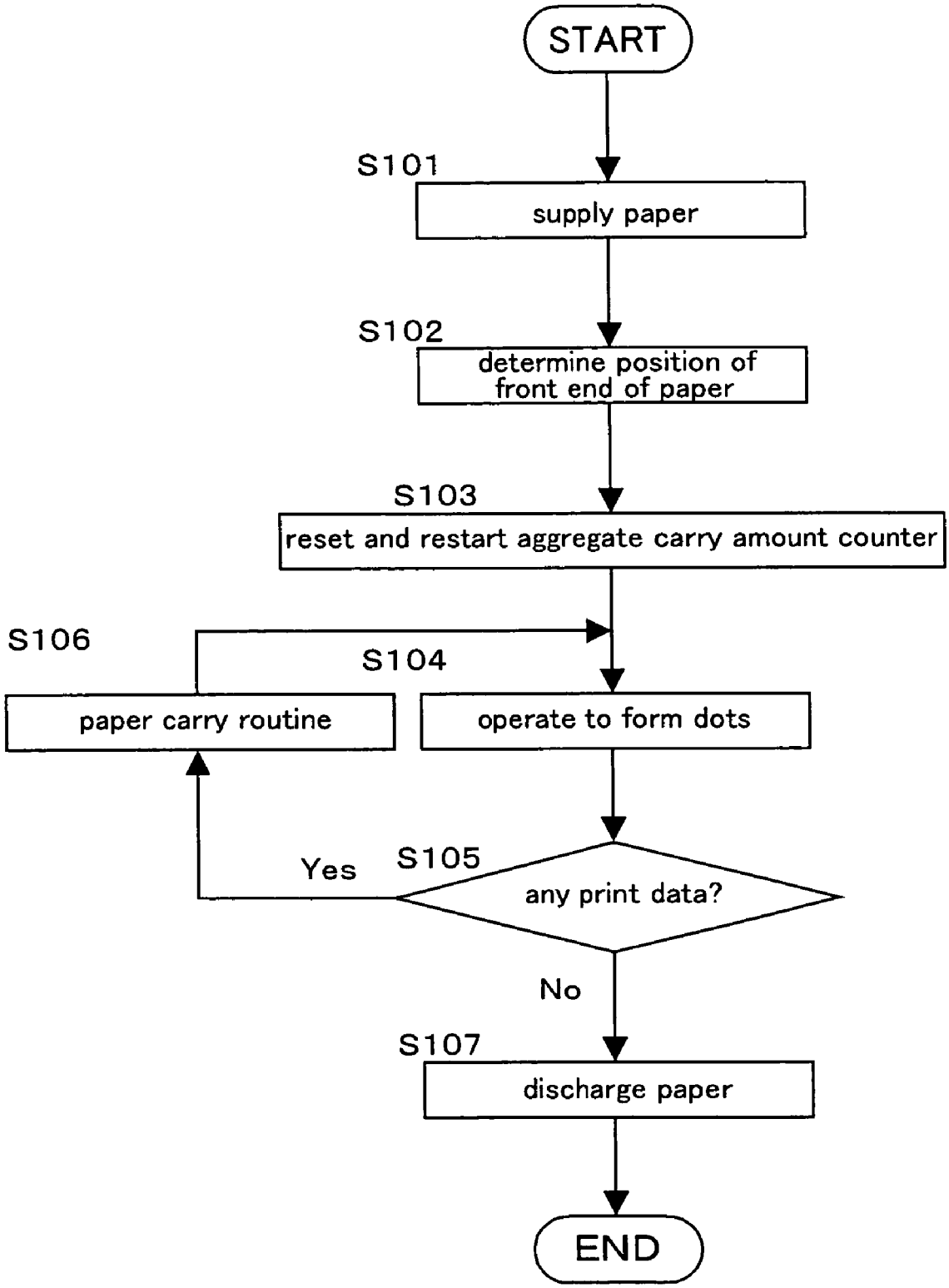
FIG. 13 is a flowchart showing the printing operation of the present embodiment.
Figure 14:
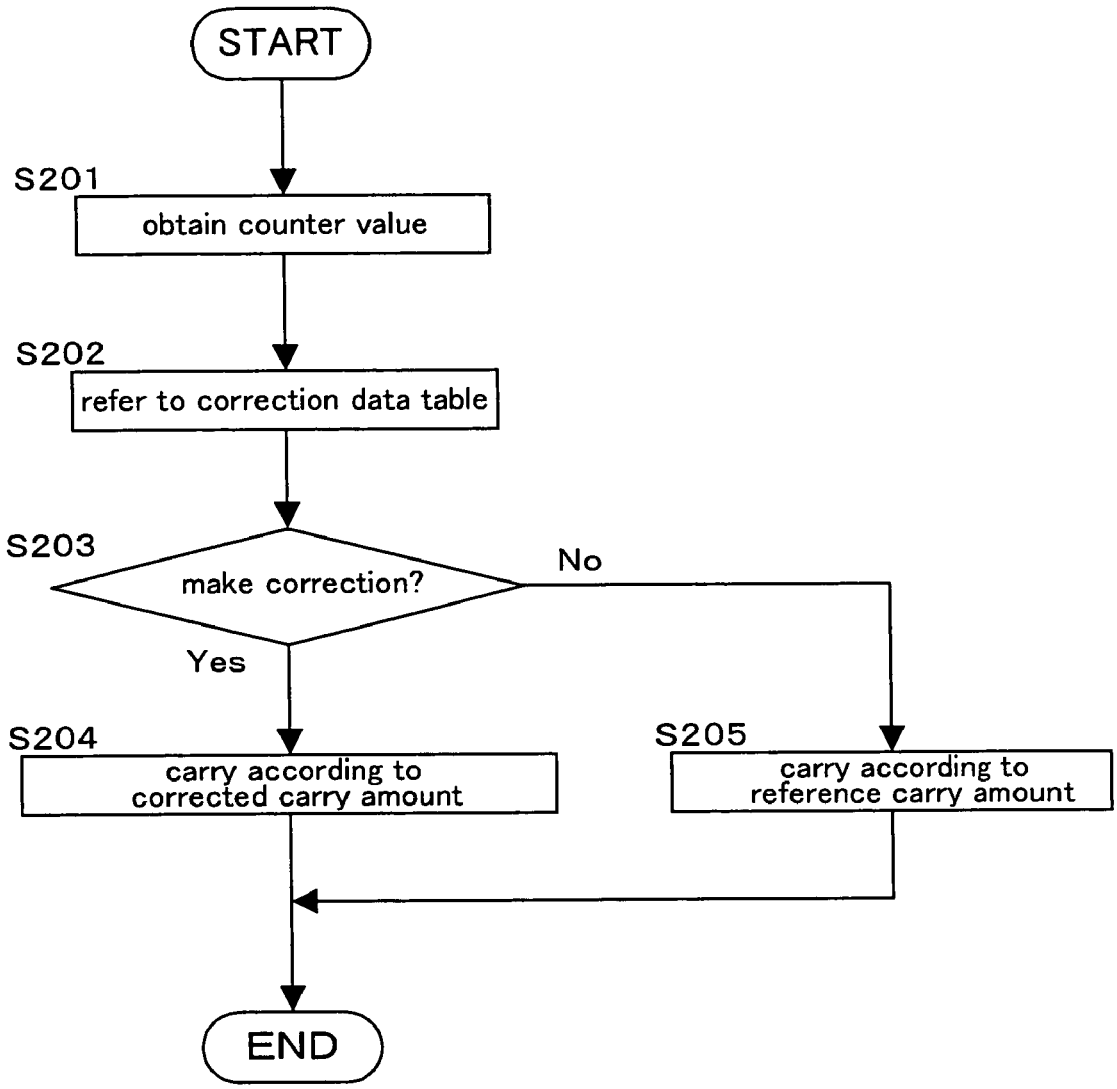
FIG. 14 is a flowchart showing the paper carry operation of the printing operation.

Using FIG. 13 and FIG. 14, the printing operation using a carry command value corresponding to the bending of the paper is described. FIG. 13 is a flowchart showing the printing operation of the present embodiment, and FIG. 14 is a flowchart showing the paper carry operation of the printing operation. In this embodiment, an example in which A4 sized thin paper is used as the recording medium will be described.

When the printer 10 receives a print command signal from the computer to which it is connected, together with information indicating the print mode selected by the user and the type of paper to be printed, such whether the paper is matte paper, normal paper, glossy paper, or OHP sheet paper and the thickness, size etc. of the respective paper, and print data in which the image or the like to be printed is converted to data suited for the print mode and the paper type, the printer is controlled by the system controller 26 to supply the paper 32 with the paper supply roller 24, starting the printing operation (S101).

The print paper 32 that has been supplied arrives at the carry roller 7 and its front end is detected by the paper detection sensor 20 on the carry route, after which the output of the rotary encoder 15 is counted and the paper is carried by a predetermined amount and arrives at the print start position (S102).

When the paper 32 is carried up to the print start position, the counter of the encoder 15 is reset and the count is restarted in order to calculate the aggregate carry amount (S103).

Next, the carriage 3 is scanned so as to form dots in an initial pass (S104). When scanning is over, the data in the image buffer 22 are confirmed (S105), and if there are no data to be printed in the next pass, the paper is discharged and printing is ended (S107). On the other hand, when there are data in the image buffer 22 to print in the next pass, the paper carry routine procedure is executed (S106).

In the paper carry routine procedure, first the count value of the encoder 15 is obtained (S201). Then, the aggregate carry amount is calculated from the count value that is obtained and the correction data table is referred to (S202) to determine whether or not the reference carry command value should be corrected as the carry command value (S203). At this time, if the aggregate carry amount that is calculated is two inches or less, then the paper 32 is carried by a carry command value obtained by adding "1" to the reference carry command value, and if the aggregate carry amount is greater than eight inches, then the paper 32 is carried by a carry command value obtained by subtracting "1" from the reference carry command value (S204). If the aggregate carry value corresponds to neither of these, then carrying is performed at the reference carry command value (S205), and the paper carry routine procedure is ended.

When the paper carry routine procedure is over, the carriage 3 is scanned so as to form dots (S104). In this way, the data in the image buffer 22 are confirmed while the dot formation operation (S104) and the paper carry routine procedure (S106) are executed repeatedly, and when there are no longer data in the image buffer 22, the paper 32 is discharged (S107), ending the printing operation.

The printer of this embodiment is configured compactly so that it can be placed in small spaces, and it can carry paper with high precision, even if the carry route of the paper is curved, by correcting the carry error of the carry amount due to the bending of the paper. Also, it has a correction data table corresponding to the type of recording medium, such as paper, thus allowing the correction amount to suit the type of medium easily regardless of the type of the medium to be printed. Moreover, the correction amount is set according to the aggregate carry amount, thus allowing carrying to be performed appropriately without the occurrence of irregularities anywhere on the paper. Thus, since the paper can be carried in a regular manner without the occurrence of irregularities, the pitch of the raster lines that are printed is stable, allowing high-quality images to be printed.

In the above-described embodiment, correction of the carry amount in the case of interlace printing was described; however, the printing method is not limited to this.

Also, in the embodiment described above, a single raster line was formed by dots constituted by ink droplets ejected from a single nozzle. However, this is not a limitation, and for example, it is also possible for a single raster line to be formed by dots constituted by ink droplets that are ejected from two or more nozzles (so-called "overlap printing mode").

It should be noted that it is of course also possible to adopt the method of correction of the carry amount according the above-described embodiment for other printing methods as well.

Also, in the above embodiment, the carry amount when the paper was carried intermittently was a constant carry amount F. The carry amount of the paper, however, is not limited to this. For example, the carry amount may differ depending on the print mode and the carry amount may by different at the upper end and the lower end of the paper. It is also possible to change the settings for the main printer unit or the printer driver, for example, so that the conditions for correcting the carry amount are different when the carry amounts are different.

In the above embodiment, ink droplets were ejected using piezo elements. However, the method for ejecting ink is not limited to this, and for example it is possible for ink droplets to be ejected from nozzles by generating bubbles using a heater. Ink droplets may be ejected using other methods as well.

In the above embodiment, the nozzles were provided in the print head 9, which was provided on the carriage 3, and thus the nozzles were provided in single unit with the carriage 3. However, the configuration of the nozzles and the print head 9 is not limited to this. For example, the nozzles or the head may be provided in a single unit with the cartridges and be attached and removed to and from the carriage.

Other Embodiments

In the foregoing, a recording apparatus, for example, according to the invention was described using an embodiment thereof. However, the foregoing embodiment of the invention is for the purpose of elucidating the present invention and is not to be interpreted as limiting the present invention. The invention can of course be altered and improved without departing from the gist thereof and includes functional equivalents.

<Configuration of the Computer System and the Like>

Next, embodiments of a computer system, a computer program, and a recording medium storing the computer program, which are examples of the embodiment according to the present invention, are explained with reference to the drawings.

Figure 15:
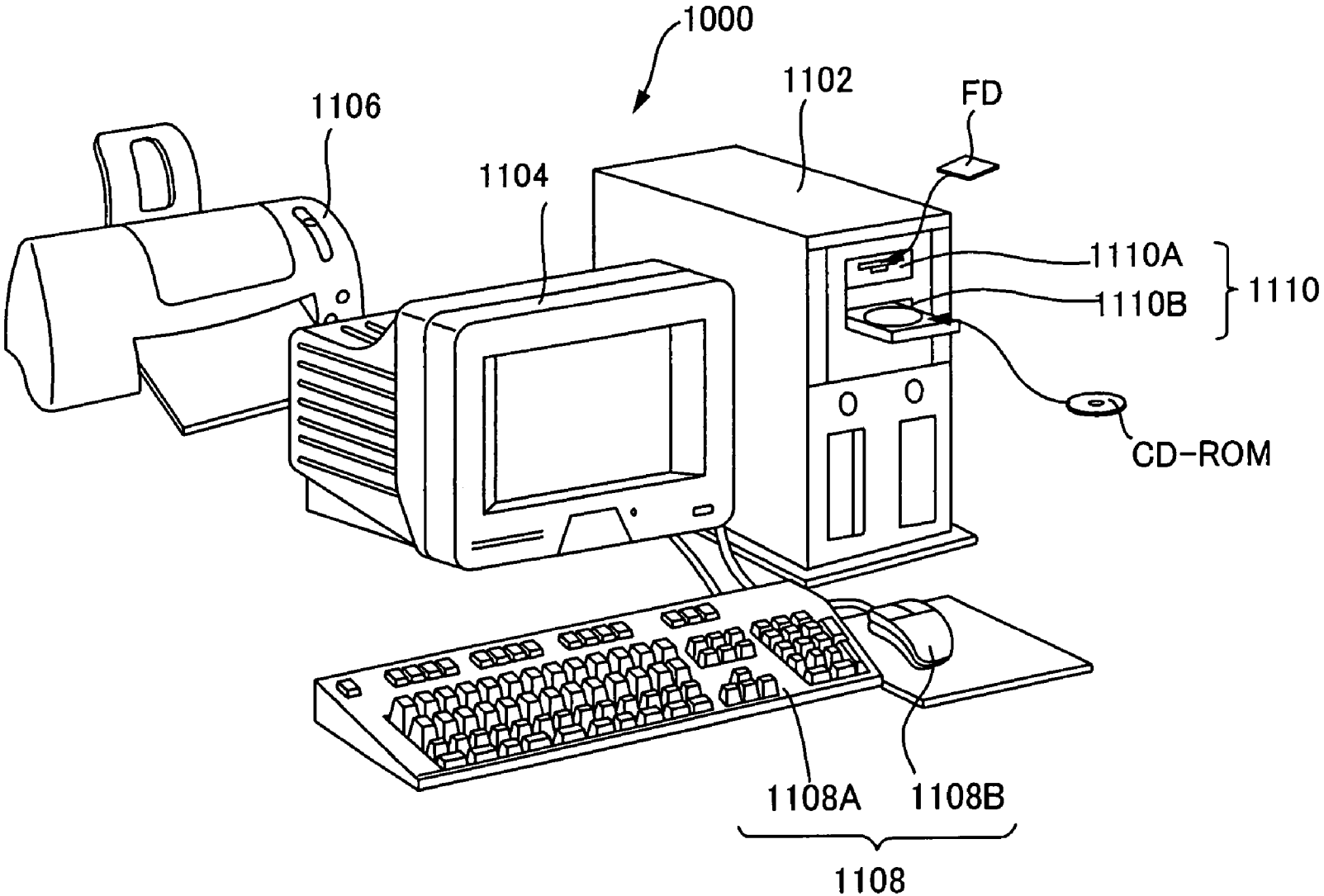
FIG. 15 is an explanatory diagram showing the external structure of the computer system.

FIG. 15 is an explanatory diagram showing the external configuration of the computer system. A computer system 1000 is provided with a main computer unit 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), plasma display, or liquid crystal display device, for example, is generally used as the display device 1104, but this is not a limitation. The printer 1106 is the printer described above. In this embodiment, the input device 1108 is a keyboard 1108A and a mouse 1108B; however, it is not limited to these. In this embodiment, a flexible disk drive device 1110A and a CD-ROM drive device 1110B are used as the reading device 1110, but the reading device 1110 is not limited to these, and it may also be a MO (magneto optical) disk drive device or a DVD (digital versatile disk), for example.

Figure 16:
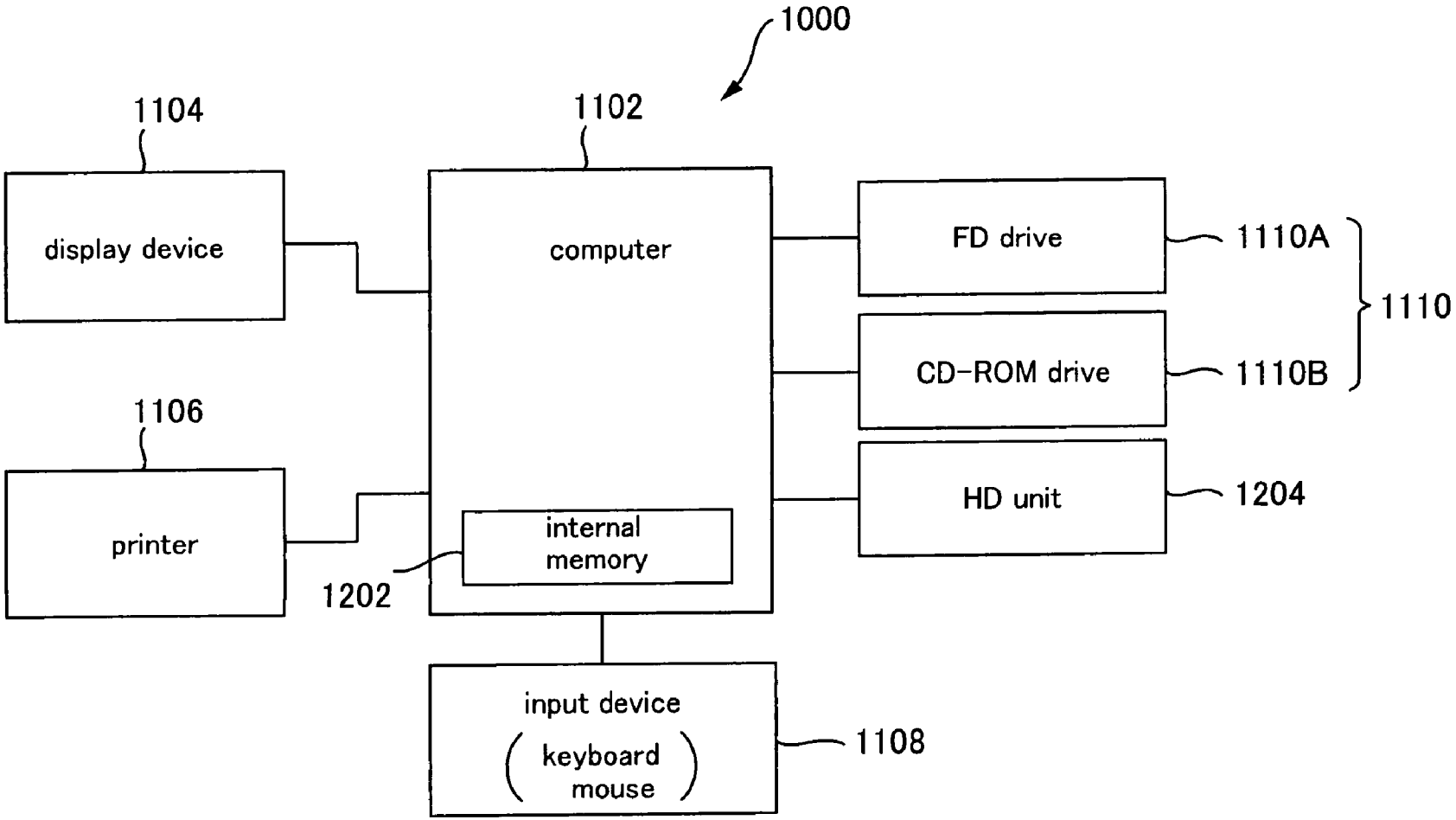
FIG. 16 is a block diagram showing the configuration of the computer system shown in FIG. 15.
Figure 17:
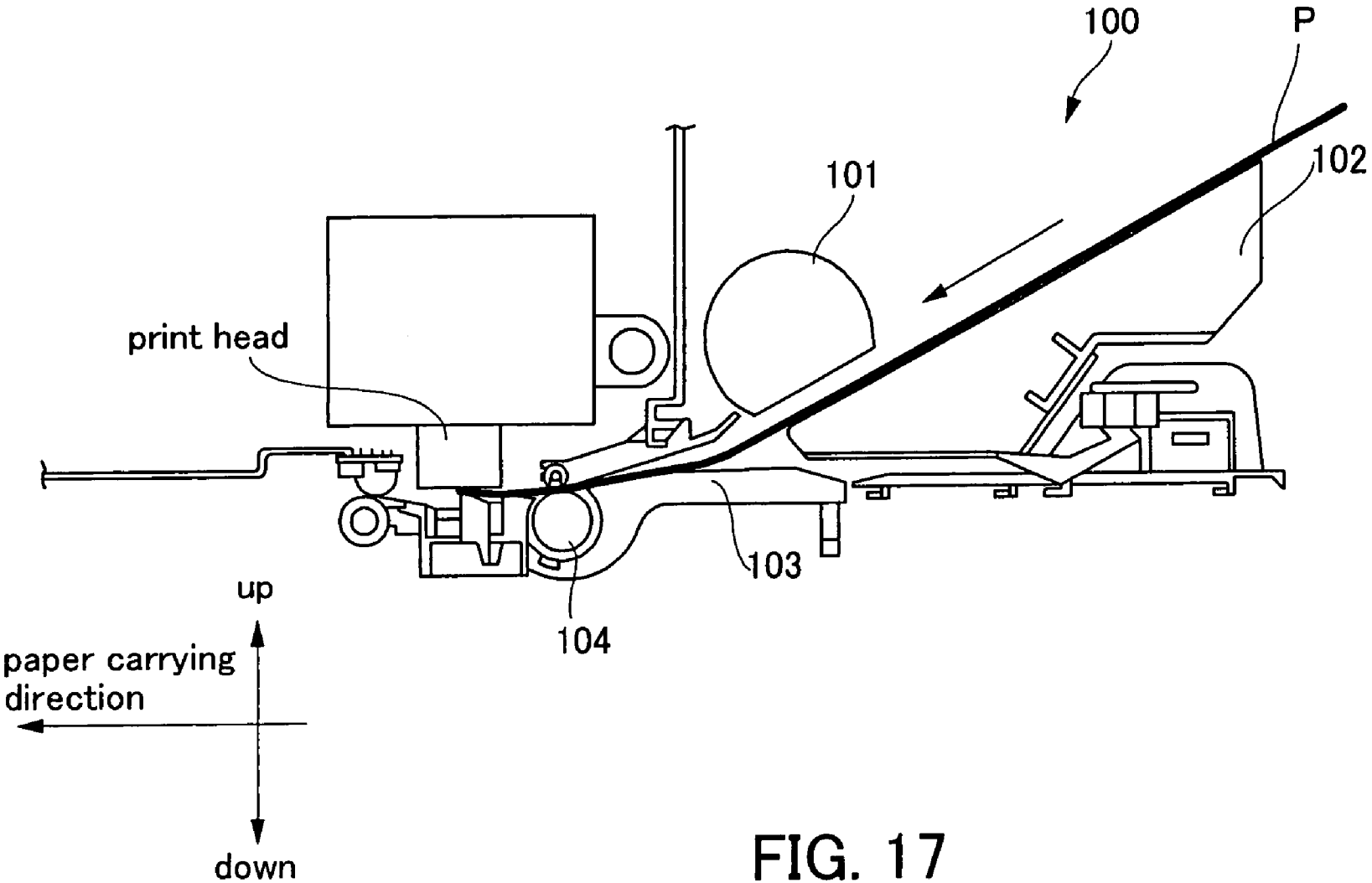
FIG. 17 is a cross-sectional view showing how paper is bent inside the inkjet printer.

FIG. 16 is a block diagram showing the configuration of the computer system shown in FIG. 15. An internal memory 1202 such as a RAM within the housing accommodating the main computer unit 1102 and, also, an external memory such as a hard disk drive unit 1204 are provided.

It should be noted that in the above description, an example was described in which the computer system is constituted by connecting the printer 1106 to the main computer unit 1102, the display device 1104, the input device 1108, and the reading device 1110; however, this is not a limitation. For example, the computer system can be made of the main computer unit 1102 and the printer 1106, and the computer system does not have to be provided with any one of the display device 1104, the input device 1108, and the reading device 1110.

It is also possible for the printer 1106 to have some of the functions or mechanisms of the main computer unit 1102, the display device 1104, the input device 1108, and the reading device 1110. For example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

As a whole system, the computer system that is thus achieved is superior to conventional systems.

With the present invention, it is possible to achieve a recording apparatus capable of carrying a recording medium with high carrying precision, a computer program for making the recording apparatus achieve the recording function, a computer system having the recording apparatus, and a recording method for recording using the recording apparatus.

What is claimed is:

1. A recording method comprising:

a step of changing a carry command value, when carrying a recording medium, according to a state of bending of said recording medium that is carried;

a step of driving at least one carry roller, which advances or withdraws said recording medium, based on said carry command value that has been changed;

a step of calculating an aggregate carry amount of said recording medium; and a step of recording, with a print head, on said recording medium that has been carried;

wherein the larger said carry command value is, the more said carry roller rotates; and wherein said carry command value is changed based on a result of said step of calculating said aggregate carry amount of said recording medium.

2. A recording method comprising:

a step of changing a carry command value, when carrying a recording medium, according to a state of bending of said recording medium that is carried;

a step of carrying said recording medium based on said carry command value that has been changed;

a step of calculating an aggregate carry amount of said recording medium; and a step of recording, with a print head, on said recording medium that has been carried;

wherein said carry command value is changed based on a result of said step of calculating said aggregate carry amount of said recording medium.

3. A recording method according to claim 1, wherein said carry command value is changed when a front end region of said recording medium is carried and when a rear end region of said recording medium is carried.

4. A recording method comprising:

a step of changing a carry command value, when carrying a recording medium, according to a state of bending of said recording medium that is carried;

a step of carrying said recording medium based on said carry command value that has been changed;

a step of calculating an aggregate carry amount of said recording medium; and a step of recording, with a print head, on said recording medium that has been carried;

wherein said carry command value is changed when a front end region of said recording medium is carried and when a rear end region of said recording medium is carried;

wherein when said front end region is carried, said carry command value is changed to a larger carry command value than when said rear end region is carried; and wherein said carry command value is changed based on a result of said step of calculating said aggregate carry amount of said recording medium.

5. A recording method according to claim 1, wherein said carry command value is changed according to an attribute of said recording medium.

6. A recording method according to claim 5, wherein an attribute of said recording medium is a thickness of said recording medium.

7. A recording method according to claim 5, wherein an attribute of said recoding medium is a length of said recording medium.

8. A recording method according to claim 5, wherein an attribute of said recoding medium is a width of said recording medium.

9. A recording method according to claim 5, wherein an attribute of said recoding medium is a material of said recording medium.

10. A recording method comprising:

changing a carry command value, when carrying a recording medium, according to a state of bending of said recording medium that is;

carrying said recording medium based on said carry command value that has been changed; and recording on said recording medium that has been carried;

wherein said carry command value is changed according to an attribute of said recording medium; and wherein said carry command value is set according to a predetermined reference carry command value, and a correction value for said reference carry command value, said correction value being associated in a data table with an aggregate carry amount of said recording medium and an attribute of said recording medium.

11. A recording method according to claim 10, wherein said data table is set for every predetermined carry amount of said recording medium.

12. A recording method comprising:

a step of changing a carry command value when carrying a front end region of a recording medium and when carrying a rear end region of said recording medium, based on a predetermined reference carry command value, and a data table indicating correction values for said predetermined reference carry command value, said correction values being set in association with a thickness, a length, a width, and a material of said recording medium and being set for every predetermined carry amount of said recording medium;

a step of making a carrying mechanism for carrying said recording medium carry said recording medium based on said carry command value that has been changed; and a step of recording on said recording medium that has been carried.

13. A computer-readable medium bearing program code instructions, intended for use in making a recording apparatus perform operations, the recording apparatus recording on a recording medium that is carried by a carrying mechanism, said operations comprising:

driving at least one carry roller, which advances or withdraws said recording medium, based on a carry command value;

changing said carry command value, when said recording medium is carried, according to a state of bending of said recording medium that is carried; and calculating an aggregate carry amount of said recording medium;

wherein the larger said carry command value is, the more he carry roller rotates; and wherein said carry command value is changed based on a result of said calculating said aggregate carry amount of said recording medium.

14. A recording apparatus for recording on a recording medium, comprising:

a carrying mechanism for advancing or withdrawing said recording medium within said recording apparatus, wherein said carrying mechanism advances or withdraws said recording medium based on a carry command value;

a control circuit which calculates an aggregate carry amount of said recording medium;

wherein said carry command value is changed according to a state of bending of said recording medium that is carried;

wherein the larger said carry command value is, the more the carrying mechanism advances or withdraws said recording medium; and wherein said carry command value is changed based on a result of said step of calculating said aggregate carry amount of said recording medium.

15. A recording method comprising:

a step of changing a carry command value when carrying a front end region of a recording medium and when carrying a rear end region of said recording medium;

a step of making a carrying mechanism, which advances or withdraws said recording medium, advance or withdraw said recording medium based on said carry command value that had been changed;

a step of calculating an aggregate carry amount of said recording medium; and a step of recording on said recording medium that has been advanced or withdrawn;

wherein the larger said carry command value is, the more the carrying mechanism advances or withdraws said recording medium; and wherein said carry command value is changed based on a result of said step of calculating said aggregate carry amount of said recording medium.

* * * * *